US009254702B1

(12) United States Patent
Brown

(10) Patent No.: US 9,254,702 B1
(45) Date of Patent: Feb. 9, 2016

(54) CLAMPING ASSEMBLY

(71) Applicant: John T. Brown, St. Louis, MO (US)

(72) Inventor: John T. Brown, St. Louis, MO (US)

( * ) Notice: Subject to any disclaimer, the term of this patent is extended or adjusted under 35 U.S.C. 154(b) by 0 days.

(21) Appl. No.: 14/471,114

(22) Filed: Aug. 28, 2014

(51) Int. Cl.
*B42F 1/00* (2006.01)
*B42F 1/02* (2006.01)

(52) U.S. Cl.
CPC . *B42F 1/006* (2013.01); *B42F 1/02* (2013.01); *Y10T 24/20* (2015.01); *Y10T 24/203* (2015.01); *Y10T 24/44615* (2015.01)

(58) Field of Classification Search
CPC ..... B42F 1/006; B42F 1/02; Y10T 24/20; Y10T 24/206; Y10T 24/202; Y10T 24/203; Y10T 24/44615
See application file for complete search history.

(56) References Cited

U.S. PATENT DOCUMENTS

| | | | | | |
|---|---|---|---|---|---|
| 844,443 | A | * | 2/1907 | Dawson | 402/66 |
| 861,816 | A | * | 7/1907 | Dawson | 402/66 |
| 864,254 | A | * | 8/1907 | Perkins | 40/1 |
| 1,063,836 | A | * | 6/1913 | Sexauer | 402/52 |
| 2,249,651 | A | * | 7/1941 | Gilbert | 24/527 |
| 2,276,313 | A | * | 3/1942 | Keppel | 24/338 |
| 2,548,389 | A | * | 4/1951 | Neikirk | 24/67.5 |
| D179,240 | S | | 11/1956 | Boker | |
| 2,863,202 | A | * | 12/1958 | Hanna | 248/300 |
| 3,308,518 | A | * | 3/1967 | Waxelbaum | 24/527 |
| 3,602,961 | A | * | 9/1971 | Shibata et al. | 24/522 |
| 4,424,811 | A | * | 1/1984 | Groot | 606/157 |
| 4,562,618 | A | | 1/1986 | Masuda | |
| 4,959,892 | A | | 10/1990 | Wang | |
| 5,079,808 | A | | 1/1992 | Brown | |
| 6,481,687 | B2 | | 11/2002 | Najmi | |
| D599,651 | S | | 9/2009 | Riggsbee | |
| 7,770,263 | B2 | | 8/2010 | Thomson et al. | |
| 2003/0088951 | A1 | * | 5/2003 | Fortenberry | 24/67 R |
| 2012/0304424 | A1 | * | 12/2012 | Yang | 24/457 |

* cited by examiner

*Primary Examiner* — Robert J Sandy
*Assistant Examiner* — Louis Mercado

(57) ABSTRACT

A clamping assembly for selectively retaining a stack of pages includes a bottom disk that may be positioned proximate the stack of pages. A tube is operationally coupled to the bottom disk. A top disk is operationally coupled to the tube. The top disk selectively compresses the stack of pages between the top and bottom disks. A retainer is operationally coupled to the top disk. The retainer retains the top disk on the stack of pages. A release is operationally coupled to the top disk. The release may selectively release the top disk from the stack of pages.

16 Claims, 6 Drawing Sheets

CLAMPING ASSEMBLY

BACKGROUND OF THE DISCLOSURE

Field of the Disclosure

The disclosure relates to clamping devices and more particularly pertains to a new clamping device for selectively retaining a stack of pages.

SUMMARY OF THE DISCLOSURE

An embodiment of the disclosure meets the needs presented above by generally comprising a bottom disk that may be positioned proximate the stack of pages. A tube is operationally coupled to the bottom disk. A top disk is operationally coupled to the tube. The top disk selectively compresses the stack of pages between the top and bottom disks. A retainer is operationally coupled to the top disk. The retainer retains the top disk on the stack of pages. A release is operationally coupled to the top disk. The release may selectively release the top disk from the stack of pages.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
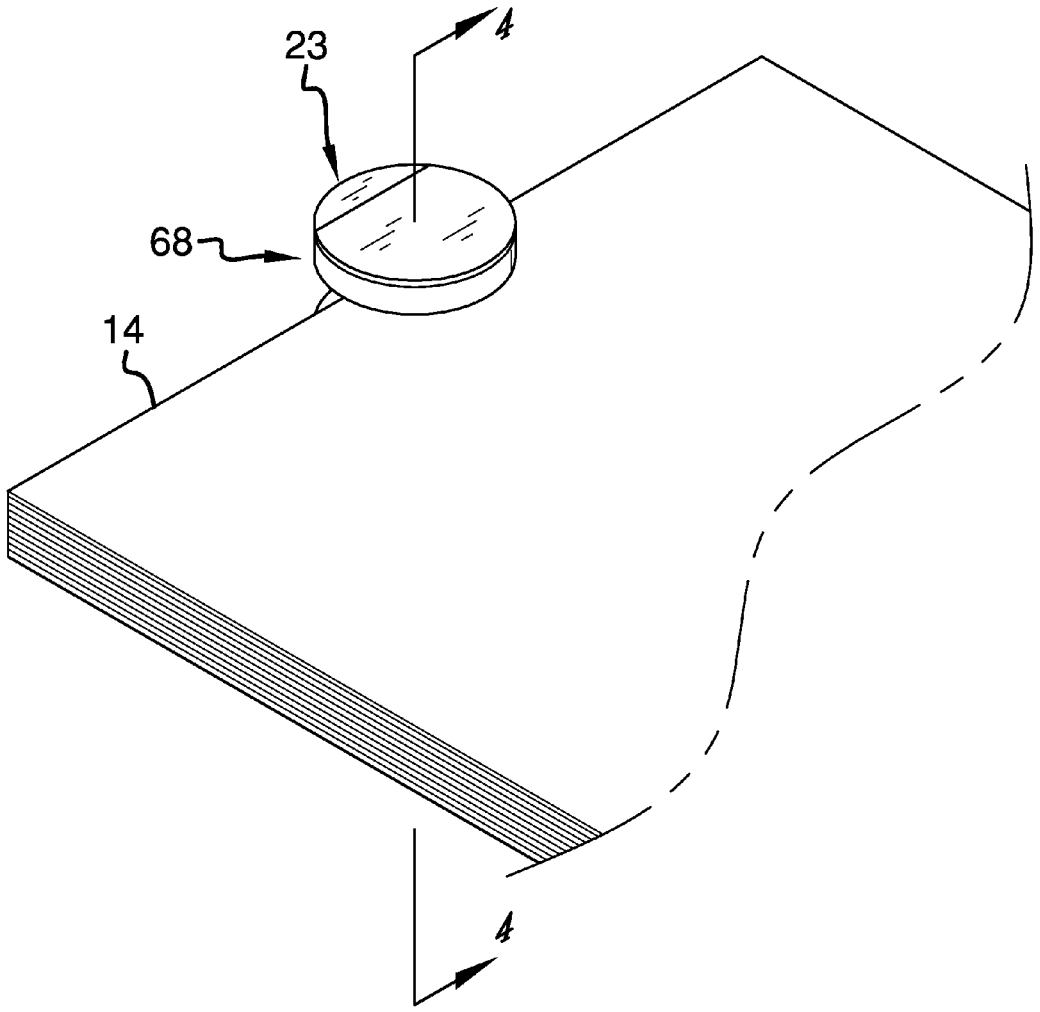
FIG. 1 is an in-use view of a clamping assembly according to an embodiment of the disclosure.
Figure 2:
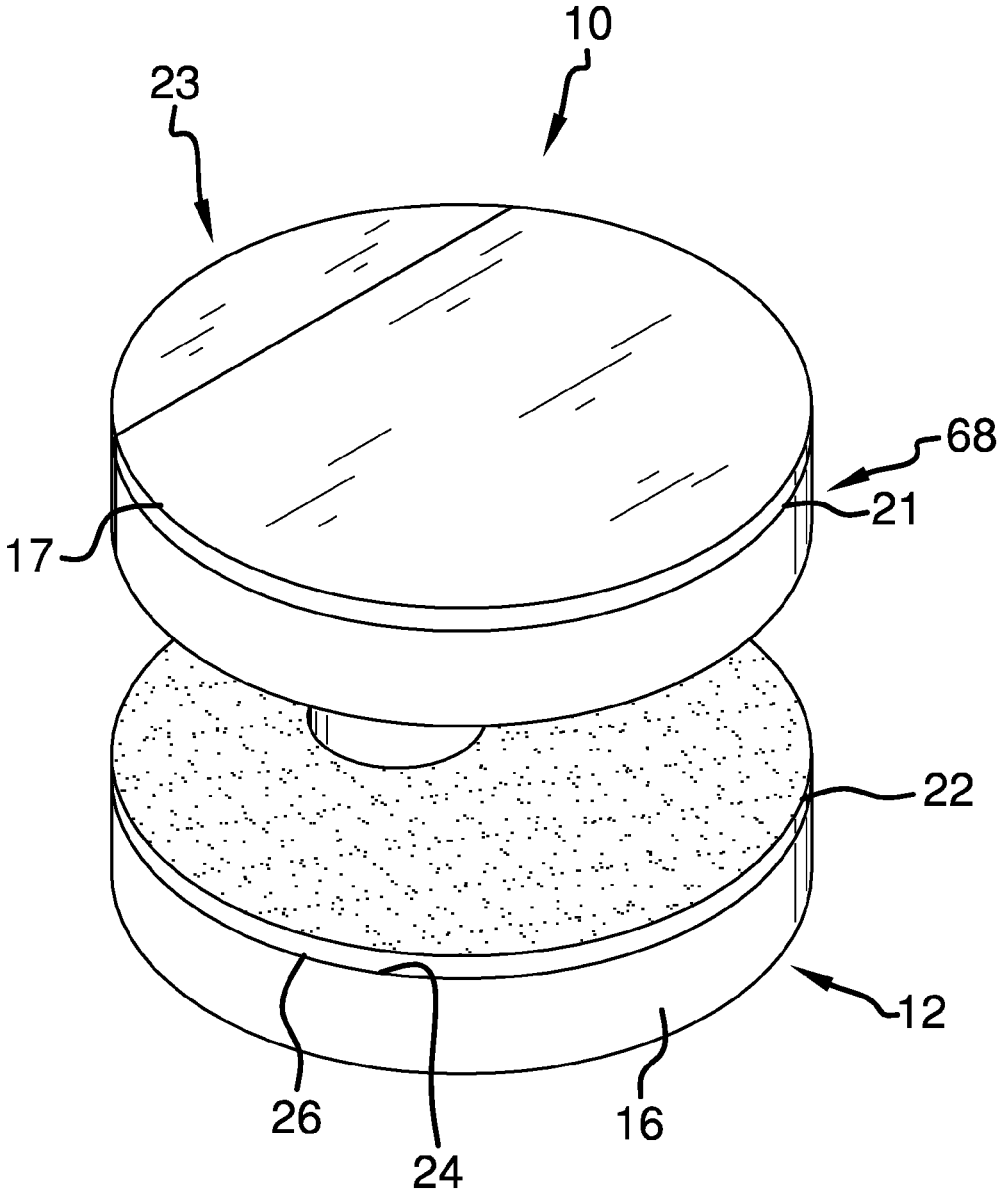
FIG. 2 is a top perspective view of an embodiment of the disclosure.
Figure 3:
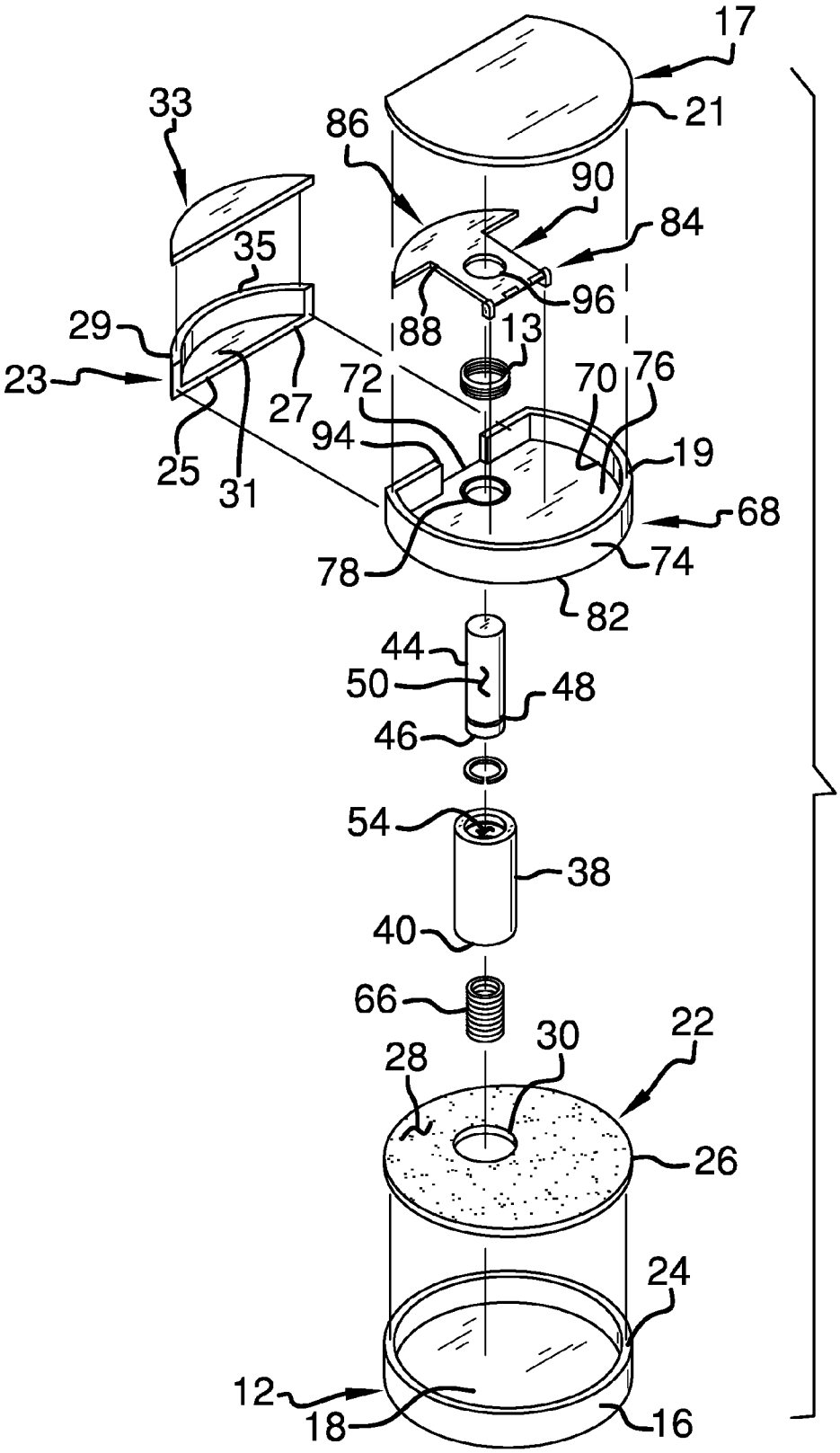
FIG. 3 is an exploded perspective view of an embodiment of the disclosure.
Figure 4:
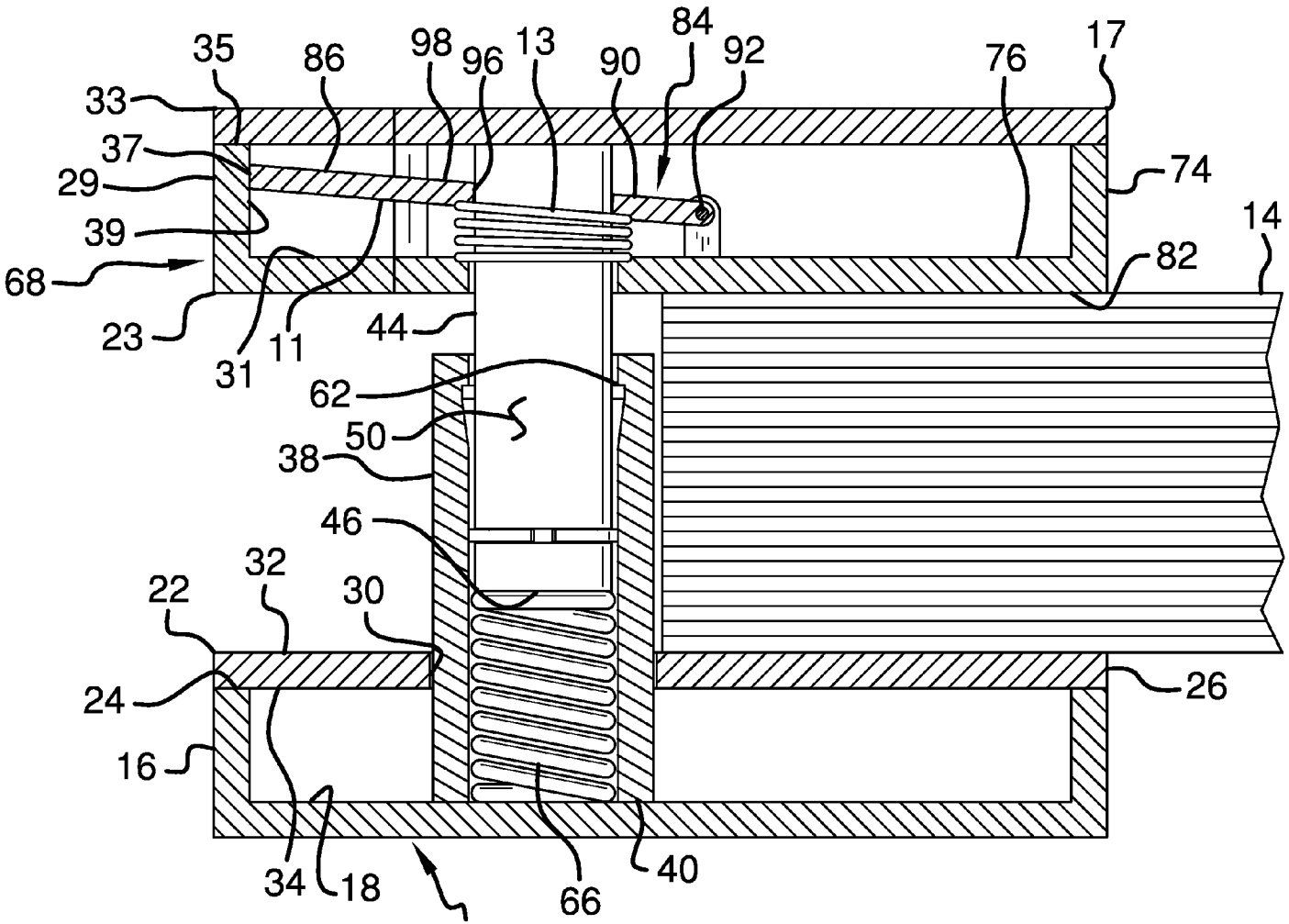
FIG. 4 is a cross sectional view taken along line 4-4 of FIG. 1 of an embodiment of the disclosure.
Figure 5:
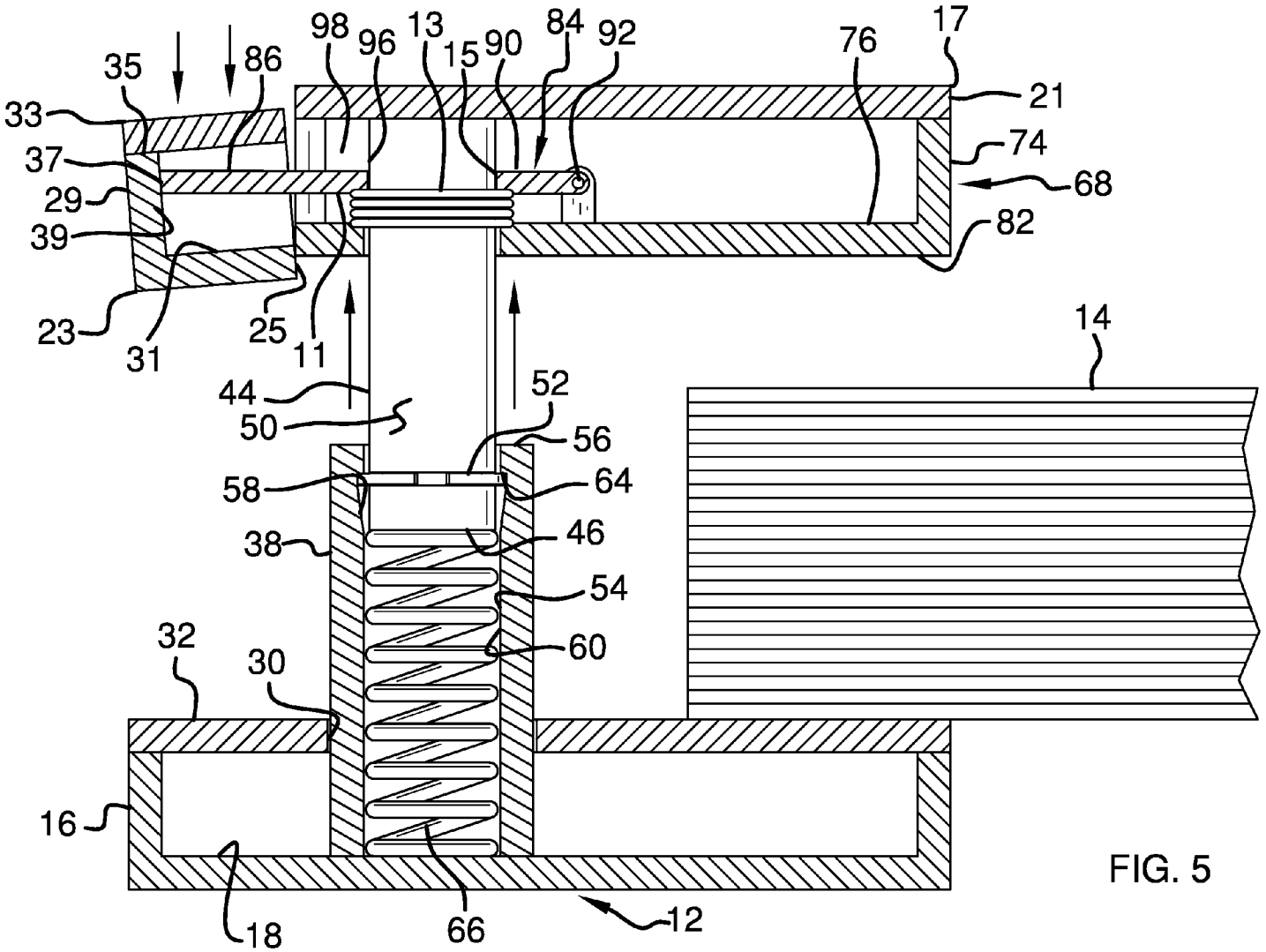
FIG. 5 is a cross sectional view taken along line 4-4 of FIG. 1 of an embodiment of the disclosure.
Figure 6:
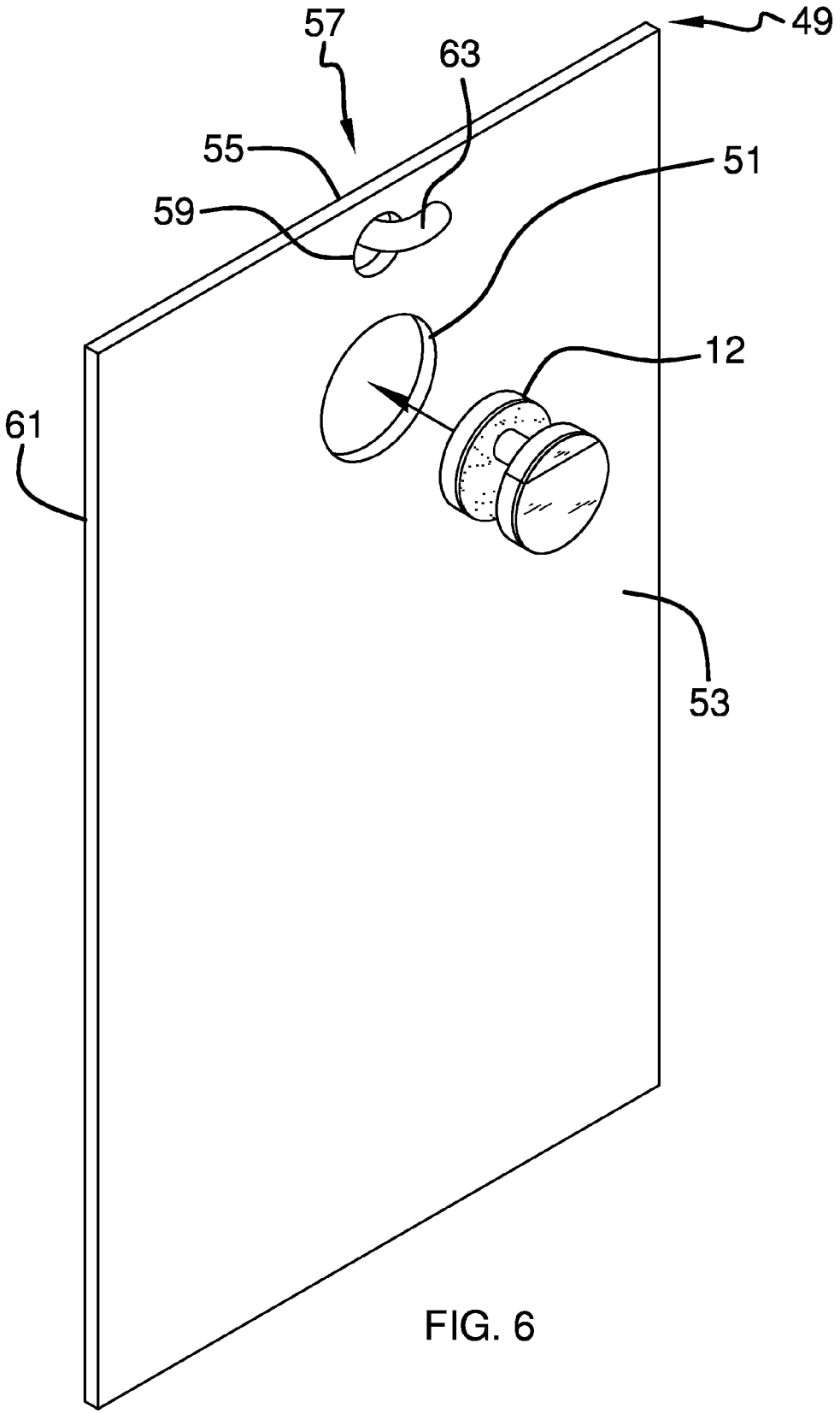
FIG. 6 is a front perspective view of an alternative embodiment of the disclosure.

With reference now to the drawings, and in particular to FIGS. 1 through 6 thereof, a new clamping device embodying the principles and concepts of an embodiment of the disclosure and generally designated by the reference numeral 10 will be described.

As best illustrated in FIGS. 1 through 6, the clamping assembly 10 generally comprises a bottom disk 12 that may be positioned proximate the stack of pages 14. The stack of pages 14 may be paper pages of any conventional design. Additionally, the bottom disk 12 may have a diameter between 12 mm and 25 mm. A lip 16 is coupled to and extends upwardly from a top side 18 of the bottom disk 12. The lip 16 is coextensive with an outer edge 20 of the bottom disk 12.

A bottom engaging disk 22 is coupled to a top edge 24 of the lip 16 on the bottom disk 12. An outer edge 26 of the bottom engaging disk 22 is coextensive with the lip 16 on the bottom disk 12. Additionally, a top surface 28 of the bottom engaging disk 22 is textured. A tube aperture 30 extends through a top side 32 and a bottom side 34 of the bottom engaging disk 22 proximate the outer edge 26 of the bottom engaging disk 22. The tube aperture 30 may have a diameter between 6 mm and 12 mm.

A tube 38 extends downwardly through the tube aperture 30. Moreover, a bottom end 40 of the tube 38 is coupled to the top side 18 of the bottom disk 12. A shaft 44 is slidably positioned within the tube 38. Further, a bottom end 46 of the shaft 44 is positioned proximate the bottom end 40 of the tube 38. A retaining groove 48 extends around an entire perimeter of an outer surface 50 of the shaft 44 proximate the bottom end 46 of the shaft 44. Continuing, a first retaining ring 52 is positioned within the retaining groove 48.

An inner surface 54 of the tube 38 is flared outwardly proximate a top end 56 of the tube 38. A flared portion 58 of the inner surface 54 of the tube 38 has a diameter that is greater than a diameter of a remaining portion 60 of the inner surface 54 of the tube 38. A second retaining ring 62 is positioned within the tube 38 so the shaft 44 extends through the second retaining ring 62. The second retaining ring 62 abuts a top edge 64 of the flared portion 58 of the inner surface 54 of the tube 38 so the second retaining ring 62 is retained within the tube 38. A primary spring biasing member 66 is positioned within the tube 38. The primary spring biasing member 66 is positioned between the top side 18 of the bottom disk 12 and the bottom end 46 of the shaft 44. Lastly, the primary spring biasing member 66 biases the shaft 44 upwardly in the tube 38 so the first retaining ring 52 abuts the second retaining ring 62.

A top disk 68 is provided. An outer edge 70 of the top disk 68 has a flat portion 72 so the top disk 68 forms a circle segment. The top disk 68 may have a diameter between 12 mm and 25 mm. Further, the flat portion 72 of the outer edge 70 of the top disk 68 defines a chord of the circle segment that may have a length between 8 mm and 20 mm. A lip 74 is coupled to and extends upwardly from a top side 76 of the top disk 68. The lip 74 is coextensive with the outer edge 70 of the top disk 68.

A flat portion of the lip 75 on the top disk 68 is coextensive with the flat portion 72 of the outer edge 70 of the top disk 68. Further, the flat portion of the lip 75 is spaced inwardly away from the flat portion 72 of the outer edge 70 of the top disk 68. The flat portion of the lip 75 may be spaced a distance between 1 mm and 2 mm from the flat portion 72 of the outer edge 70 of the top disk 68.

A primary shaft aperture 78 extends through the top side 76 and a bottom side 82 of the top disk 68 proximate the flat portion 72 of the outer edge 70 of the top disk 68. The primary shaft aperture 78 may have a diameter between 4 mm and 10 mm. The shaft extends 44 upwardly through the primary shaft aperture 78 in the top disk 68. Moreover, the top disk 68 is coupled to the shaft 44. The bottom side 82 of the top disk 68 is textured.

A retainer 84 is provided. A rounded portion 86 of the retainer 84 is coupled to a second end 88 of a straight portion 90 of the retainer 84. Moreover, the retainer 84 has a T-shape. A first end 92 of the straight portion 90 of the retainer 84 is hingedly coupled to the top side 76 of the top disk 68. The straight portion 90 of the retainer 84 extends outwardly through an opening 94 in the lip 74 on the top disk 68. Moreover, the rounded portion 86 of the retainer 84 is positioned outside of the lip 74 on the top disk 68. The rounded portion 86 of the retainer 84 may have a width between 6 mm and 18 mm. Further, the straight portion 90 of the retainer 84 may have a length between 4 mm and 16 mm.

A secondary shaft aperture 96 extends through a top side 98 and a bottom side 11 of the straight portion 90 of the retainer 84. The secondary shaft aperture 96 may have a diameter between 4 mm and 10 mm. Additionally, the shaft 44 extends upwardly through the secondary shaft aperture 96 in the straight portion 90 of the retainer 84. A secondary spring biasing member 13 is positioned around the shaft 44. The secondary spring biasing member 13 is positioned between the bottom side 11 of the straight portion 90 retainer 84 and the top side 76 of the top disk 68. Moreover, the secondary spring biasing member 13 biases the retainer 84 into a retaining position. An outer edge 15 of the secondary shaft aperture 96 in the straight portion 90 of the retainer 84 engages the outer surface 50 of the shaft 44.

A cover 17 is coupled to a top edge 19 of the lip 74 on the top disk 68 so an outer edge 21 of the cover 17 is coextensive with the lip 74 on the top disk 68. A release 23 is provided. An outer edge 25 of the release 23 has a flat portion 27 so the release 23 forms a circle segment. Continuing, the outer edge 25 of the release 23 defines a chord of the circle segment that may have a length between 8 mm and 20 mm. The release 23 is operationally coupled to the top disk 68. Continuing, the flat portion 27 of the outer edge 25 of the release 23 abuts the flat portion 72 of the outer edge 70 of the top disk 68. The release 23 and the top disk 68 form a complete circle.

A lip 29 is coupled to and extends upwardly from a top side 31 of the release 23. The lip 29 on the release 23 is coextensive with the outer edge 25 of the release 23. A cover 33 is coupled to a top edge 35 of the lip 29 on the release 23. The cover 33 is coextensive with the lip 29 on the release 23. Continuing, the rounded portion 86 of the retainer 84 is positioned with the release 23. An outer edge 37 of the rounded portion 86 of the retainer 84 is coextensive with an inner surface 39 of the lip 29 on the release 23.

A flat portion of the lip 29 on the release 23 is coextensive with flat portion 27 of the outer edge 25 of the release 23. An opening in the flat portion of the lip 29 on the release 23 receives the rounded portion 86 of the retainer 84. Continuing, the flat portion of the lip 29 on the release 23 is spaced rearwardly from the flat portion 27 of the outer edge 25 of the release 23. The flat portion of the lip 29 on the release 23 may be spaced a distance between 1 mm and 2 mm from the flat portion of the lip 29 on the release 23.

An adhesive layer 43 completely covers a bottom side 45 of the bottom disk 12. A coupler 47 is coextensively coupled to the adhesive layer 43. The adhesive layer retains the coupler on the bottom side 45 of the bottom disk 12. Continuing, the coupler 47 may be a hook and loop fastener of any conventional design. Alternatively, the coupler 47 may be a magnet of any conventional design. The coupler 47 engages a support surface so the assembly 10 is retained on the support surface.

In an alternative embodiment, the bottom disk 12 may be coupled to a clip board 49. A disk well 51 extends rearwardly into a front side 53 of the clip board 49 proximate a top edge 55 of the clip board 49. Moreover, the disk well 51 is positioned proximate a center 57 of the top edge 55 of the clip board 49. The bottom disk 12 is positioned within the disk well 51. Continuing, a hanging aperture 59 extends through the front side 53 and a back side 61 of the clip board 49. The hanging aperture 59 is positioned between the disk well 51 and the top edge 55 of the clip board 49. Finally, the hanging aperture 59 may insertably receive a support 63 so the clip board 49 may be hung from the support 63.

In use, the stack of pages 14 is selectively positioned between the top 68 and bottom 12 disks. The top disk 68 is urged downwardly so the stack of pages 14 is compressed between the 28 top surface of the bottom engaging disk 22 and the bottom side 82 of the top disk 68. The retainer 84 is positioned in a retaining position so the stack of pages 14 is retained between the top 68 and bottom 12 disks. Continuing, the release 23 is selectively depressed so the retainer 84 is urged into a releasing position. The shaft 44 freely moves in the secondary shaft aperture 96 in the retainer 84. Moreover, the primary spring biasing member 66 biases the top disk 68 upwardly away from the stack of pages 14 so the stack of pages 14 are removable from the assembly 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A clamping assembly for selectively retaining a stack of pages, said assembly comprising:

a bottom disk configured to be positioned proximate the stack of pages;

a tube operationally coupled to said bottom disk;

a top disk operationally coupled to said tube wherein said top disk selectively compresses the stack of pages between said top and bottom disks;

a retainer operationally coupled to said top disk wherein said retainer retains said top disk on the stack of pages; and a release operationally coupled to said top disk wherein said release is configured to selectively release said top disk from the stack of pages; and a shaft slidably positioned within said tube wherein a bottom end of said shaft is positioned proximate a bottom end of said tube.

2. The assembly according to claim 1 further comprising a lip coupled to and extending upwardly from a top side of said bottom disk wherein said lip is coextensive with an outer edge of said bottom disk.

3. The assembly according to claim 1 further comprising a bottom engaging disk coupled to a top edge of a lip on said bottom disk wherein an outer edge of said bottom engaging disk is coextensive with said lip on said bottom disk.

4. The assembly according to claim 1 further comprising a tube aperture extending through a top side and a bottom side of a bottom engaging disk proximate an outer edge of said bottom engaging disk.

5. The assembly according to claim 1 further comprising said tube extending downwardly through a tube aperture wherein the bottom end of said tube is coupled to a top side of said bottom disk.

6. The assembly according to claim 1 further comprising a primary spring biasing member positioned within said tube wherein said primary spring biasing member is positioned between a top side of said bottom disk and the bottom end of said shaft wherein said primary spring biasing member biases said shaft upwardly in said tube.

7. The assembly according to claim 6, further comprising a secondary spring biasing member positioned around the shaft wherein said secondary spring biasing member is positioned between a bottom side of said retainer and a top side of said top disk wherein said secondary spring biasing member biases said retainer into a retaining position wherein an outer edge of a secondary shaft aperture in a straight portion of said retainer engages an outer surface of said shaft.

8. The assembly according to claim 6, further comprising said release being selectively depressed wherein said retainer is urged into a releasing position wherein the shaft freely moves in a secondary shaft aperture in said retainer wherein the primary spring biasing member biases said top disk upwardly away from the stack of pages wherein the stack of pages are removable from said assembly.

9. The assembly according to claim 1 further comprising:

of an outer edge of said top disk having a flat portion wherein said top disk forms a circle segment; and a lip coupled to and extending upwardly from a top side of said top disk wherein said lip is coextensive with said outer edge of said top disk.

10. The assembly according to claim 1 further comprising the stack of pages being selectively positioned between said top and bottom disks wherein said top disk is urged downwardly wherein the stack of paper is compressed between a top surface of a bottom engaging disk and a bottom side of said top disk wherein said retainer is positioned in a retaining position wherein the stack of pages is retained between said top and bottom disks.

11. The assembly according to claim 1, further comprising:

a lip coupled to and extending upwardly from a top side of said bottom disk wherein said lip is coextensive with an outer edge of said bottom disk;

a bottom engaging disk coupled to a top edge of said lip on said bottom disk wherein an outer edge of said bottom engaging disk is coextensive with said lip on said bottom disk;

a tube aperture extending through a top side and a bottom side of said bottom engaging disk proximate the outer edge of said bottom engaging disk;

said tube extending downwardly through said tube aperture wherein a bottom end of said tube is coupled to said top side of said bottom disk;

a primary spring biasing member positioned within said tube wherein said primary spring biasing member is positioned between said top side of said bottom disk and said bottom end of said shaft wherein said primary spring biasing member biases said shaft upwardly in said tube;

said top disk comprising an outer edge of said top disk having a flat portion wherein said top disk forms a circle segment;

a lip coupled to and extending upwardly from a top side of said top disk wherein said lip is coextensive with said outer edge of said top disk;

a primary shaft aperture extending through the top side and a bottom side of said top disk proximate said flat portion of said outer edge of said top disk, said shaft extending upwardly through said primary shaft aperture in said top disk wherein said top disk is coupled to said shaft;

said retainer comprising a rounded portion of said retainer coupled to a second end of a straight portion of said retainer wherein said retainer has a T-shape, a first end of said straight portion of said retainer being hingedly coupled to said top side of said top disk wherein said straight portion of said retainer extends outwardly through an opening in said lip on said top disk wherein said rounded portion of said retainer is positioned outside of said lip on said top disk; and a secondary shaft aperture extending through a top side and a bottom side of said straight portion of said retainer wherein said shaft extends upwardly through said secondary shaft aperture in said straight portion of said retainer;

a secondary spring biasing member positioned around said shaft wherein said secondary spring biasing member is positioned between a bottom side of said retainer and said top side of said top disk wherein said secondary spring biasing member biases said retainer into a retaining position wherein an outer edge of said secondary shaft aperture in said straight portion of said retainer engages an outer surface of said shaft;

a cover coupled to a top edge of said lip on said top disk wherein an outer edge of said cover is coextensive with said lip on said top disk;

said release comprising an outer edge of said release having a flat portion wherein said release forms a circle segment, said release being operationally coupled to said top disk wherein said flat portion of said outer edge of said release abuts said flat portion of said outer edge of said top disk wherein said release and said top disk forms a complete circle;

a lip coupled to and extending upwardly from a top side of said release wherein said lip on said release is coextensive with said outer edge of said release;

a cover coupled to a top edge of said lip on said release wherein said cover is coextensive with said lip on said release;

said rounded portion of said retainer being positioned with said release wherein an outer edge of said rounded portion of said retainer is coextensive with an inner edge of said lip on said release;

the stack of pages being selectively positioned between said top and bottom disks wherein said top disk is urged downwardly wherein the stack of paper is compressed between a top surface of said bottom engaging disk and said bottom side of said top disk wherein said retainer is positioned in the retaining position wherein the stack of pages is retained between said top and bottom disks; and said release being selectively depressed wherein said retainer is urged into a releasing position wherein said shaft freely moves in said secondary shaft aperture in said retainer wherein said primary spring biasing member biases said top disk upwardly away from the stack of pages wherein the stack of pages are removable from said assembly.

12. A clamping assembly for selectively retaining a stack of pages, said assembly comprising:

a bottom disk configured to be positioned proximate the stack of pages;

a tube operationally coupled to said bottom disk;

a top disk operationally coupled to said tube wherein said top disk selectively compresses the stack of pages between said top and bottom disks;

a retainer operationally coupled to said top disk wherein said retainer retains said top disk on the stack of pages;

a release operationally coupled to said top disk wherein said release is configured to selectively release said top disk from the stack of pages; and a primary shaft aperture extending through a top side and a bottom side of said top disk proximate a flat portion of an outer edge of said top disk.

13. The assembly according to claim 12 further comprising a shaft extending upwardly through the primary shaft aperture in said top disk wherein said top disk is coupled to said shaft.

14. A clamping assembly for selectively retaining a stack of pages, said assembly comprising:

a bottom disk configured to be positioned proximate the stack of pages;

a tube operationally coupled to said bottom disk;

a top disk operationally coupled to said tube wherein said top disk selectively compresses the stack of pages between said top and bottom disks;

a retainer operationally coupled to said top disk wherein said retainer retains said top disk on the stack of pages;

a release operationally coupled to said top disk wherein said release is configured to selectively release said top disk from the stack of pages;

a rounded portion of said retainer coupled to a second end of a straight portion of said retainer wherein said retainer has a T-shape;

a first end of the straight portion of said retainer being hingedly coupled to a top side of said top disk wherein said straight portion of said retainer extends outwardly through an opening in a lip on said top disk wherein the rounded portion of said retainer is positioned outside of said lip on said top disk; and a secondary shaft aperture extending through a top side and a bottom side of the straight portion of said retainer wherein a shaft extends upwardly through said secondary shaft aperture in said straight portion of said retainer.

15. A clamping assembly for selectively retaining a stack of pages, said assembly comprising:

a bottom disk configured to be positioned proximate the stack of pages;

a tube operationally coupled to said bottom disk;

a top disk operationally coupled to said tube wherein said top disk selectively compresses the stack of pages between said top and bottom disks;

a retainer operationally coupled to said top disk wherein said retainer retains said top disk on the stack of pages;

a release operationally coupled to said top disk wherein said release is configured to selectively release said top disk from the stack of pages; and a cover coupled to a top edge of a lip on said top disk wherein an outer edge of said cover is coextensive with said lip on said top disk.

16. A clamping assembly for selectively retaining a stack of pages, said assembly comprising:

a bottom disk configured to be positioned proximate the stack of pages;

a tube operationally coupled to said bottom disk;

a top disk operationally coupled to said tube wherein said top disk selectively compresses the stack of pages between said top and bottom disks;

a retainer operationally coupled to said top disk wherein said retainer retains said top disk on the stack of pages;

a release operationally coupled to said top disk wherein said release is configured to selectively release said top disk from the stack of pages;

an outer edge of said release having a flat portion wherein said release forms a circle segment;

a lip coupled to and extending upwardly from a top side of said release wherein said lip on said release is coextensive with said outer edge of said release;

said release being operationally coupled to said top side wherein said flat portion of said outer edge of said release abuts a flat portion of an outer edge of said top disk wherein said release and said top disk forms a complete circle;

a cover coupled to a top edge of said lip on said release wherein said cover is coextensive with said lip on said release; and a rounded portion of said retainer being positioned with said release wherein an outer edge of said rounded portion of said retainer is coextensive with an inner edge of said lip on said release.

* * * * *